United States Patent [19]

Adachi et al.

[11] 4,341,915

[45] Jul. 27, 1982

[54] APPARATUS FOR FILLING OF CONTAINER WITH RADIOACTIVE SOLID WASTES

[75] Inventors: Toshio Adachi, Nagoya; Susumu Hiratake, Kasugai, both of Japan

[73] Assignee: Daidotokushuko Kabushikikaisha, Japan

[21] Appl. No.: 128,984

[22] Filed: Mar. 10, 1980

[30] Foreign Application Priority Data

Mar. 13, 1979 [JP] Japan ..... 54-28899
Feb. 12, 1980 [JP] Japan ..... 55-15805

[51] Int. Cl.[3] ..... G21F 9/30

[52] U.S. Cl. ..... 373/22; 252/632; 264/0.5

[58] Field of Search ..... 252/301.1 W; 13/2, 33; 264/0.5

[56] References Cited

U.S. PATENT DOCUMENTS 4,139,360 2/1979 Piper ..... 252/301.1 W
4,221,680 9/1980 Hardwick et al. ..... 252/301.1 W

FOREIGN PATENT DOCUMENTS 2361732 6/1975 Fed. Rep. of Germany ... 252/301.1 W
2536699 4/1976 Fed. Rep. of Germany ... 252/301.1 W
2112230 6/1972 France ..... 13/2

OTHER PUBLICATIONS

Bonniaud et al., "Large Scale Waste Glass Production", *Proc. Conf. High-Level Rad. Solid Waste Forms,* 1978, pp. 155–184.

Gilmore, Ed., *Radioactive Waste Disposal: Low and High Level,* Noyes Data Corp., Park Ridge, N.J., 1977, pp. 117–118.

*Primary Examiner*—Deborah L. Kyle
*Attorney, Agent, or Firm*—William A. Drucker

[57] ABSTRACT

An apparatus for filling a container with radioactive solid wastes comprises a melting furnace for melting the wastes and a feed-in device for feeding the wastes into the melting furnace. The wastes introduced into the feed-in device through a charge port are fed laterally and fed from an inlet formed in the side wall of the melting furnace into the melting furnace. The wastes fed into the melting furnace are melted therein, and a resultant melt is poured from an outlet formed in the side wall of the melting furnace into a top-open container placed under the outlet.

4 Claims, 13 Drawing Figures

APPARATUS FOR FILLING OF CONTAINER WITH RADIOACTIVE SOLID WASTES

BACKGROUND OF THE INVENTION

1. Field of the Invention

This invention relates to an apparatus for filling a container with radioactive wastes, particularly, miscellaneous incombustible solid wastes, arising from atomic power plants or other establishments for handling radioactive materials.

2. Description of the Prior Art

Since in such radioactive wastes, the radioactive rays emitted therefrom exert a great influence upon living things in the natural world including humankind, the wastes need be stored until the amount of the radioactive rays is decreased and the final disposal thereof (for example, such as abandonment into the seas or burying under the ground) has been done. In this case, the radioactive wastes are received and stored within a storing container in order to prevent scattering of radioactive nuclide adhered to the surface of the radioactive wastes when it falls off and to prevent dispersion of small radioactive wastes.

However, when the container is filled with the solid wastes without modification, there are produced a number of clearances between the wastes within the container, as a consequence of which the quantity of the wastes capable of being filled into a vacant space of a predetermined volume of the container becomes small. Further, if the wastes are those which include many hollow portions therein such as pipes and filters and thus have a large apparent volume as compared to a volume of pure solid portions, the quantity capable of being filled into the container becomes small similarly to the previous case. This means an increase in the number of containers required when the wastes arising from the establishments as described above are filled into the containers and thus high costs result accordingly and in addition, the increase in the number of containers means the need of a large area where the containers are stored. Both the cases as described above are not desirable.

In view of the foregoing, the present inventor has conceived methods, one of which method comprises melting such wastes within a crucible of a high frequency induction furnace or an arc furnace, tilting the furnace body to transfer the molten wastes into a solidifying container for solidification, and transferring the solidified wastes into a storing container for storage. The other method comprises gripping the wastes by a gripper, irradiating plasma arcs towards the thus gripped wastes to consecutively melt them from a part thereof, dropping the molten wastes into the storing container until the container is filled, and storing the same.

However, the former method has a problem of requiring much labor during the operation. In the latter method, where a number of small wastes are treated, the method comprises gripping them one by one by a gripper to melt the wastes, removing a portion of the waste gripped by the gripper but not molten from the gripper, and gripping another waste, such steps being required to be performed repeatedly, thus posing a problem of requiring much labor. Also, where the wastes are collapsible in nature, there poses a problem of involving a difficulty in gripping them by a gripper. In addition, since these methods require much labor as described above, there is a possible danger that operators are increasingly injured by the radioactivity.

Accordingly, these methods have been difficult to put for practical use in actual working sites.

SUMMARY OF THE INVENTION

It is therefore an object of the present invention to provide an apparatus which can melt various radioactive solid wastes and fill the molten wastes into a container used for storing the radioactive wastes.

In the apparatus of the present invention, the radioactive solid wastes are once melted and then permitted to flow into a container, and therefore, the container can be filled with the wastes in a given vacant space thereof with high density. Further, even if the radioactive solid wastes are those which include many hollow portions therein and thus have a large apparent volume as compared to a volume of pure solid portions as previously mentioned, the apparent volume can be minimized to fill the container with high density.

It is a further object of the present invention to provide an apparatus which in filling a container with radioactive solid wastes, can fill the container with the wastes by totally the similar operation irrespective of difference in the shape, construction and material of the radioactive wastes, that is, by only the simple operation for feeding the wastes into a transporting frame.

It is another object of the present invention to provide an apparatus which in the case the wastes are molten as described above, can effect the operation for melting the wastes with extremely good operability and safely even if such wastes are of a great variety of kinds.

That is, the apparatus of the present invention is of the construction in which the wastes are moved into a melting furnace and accordingly, labor is merely required when the wastes are placed on the floor in the transporting frame whereby the wastes are fed into the melting furnace by the transporting means while being guided along the guide walls. Since the wastes are guided along the guide walls, even small or collapsible wastes, to say nothing of large wastes, can be fed into the melting furnace merely requiring labor to place them on the floor.

Thus, the operation is extremely simple, the operator involves little danger to be exposed to the radioactivity, and the operation can be performed safely.

It is yet another object of the present invention to provide an apparatus of the construction which can use the transporting means for feeding the wastes into the melting furnace as described above for a long period of service life.

Since the apparatus of the present invention is of the construction in which the wastes are laterally moved, while being guided along the guide walls, into the melting furnace, the transporting means may be positioned behind the wastes to force the wastes into the furnace or may move away from the furnace immediately after the wastes is fed into the furnace. In any case, the degree in which the transporting means is exposed to hot gases within the furnace is minimized, and consequently, the transporting means is less damaged to render the use of longer period of service life thereof possible.

Other objects and advantages of the invention will become apparent during the following discussion of the accompanying drawings.

DETAILED DESCRIPTION OF THE PREFERRED EMBODIMENTS

Figure 1:
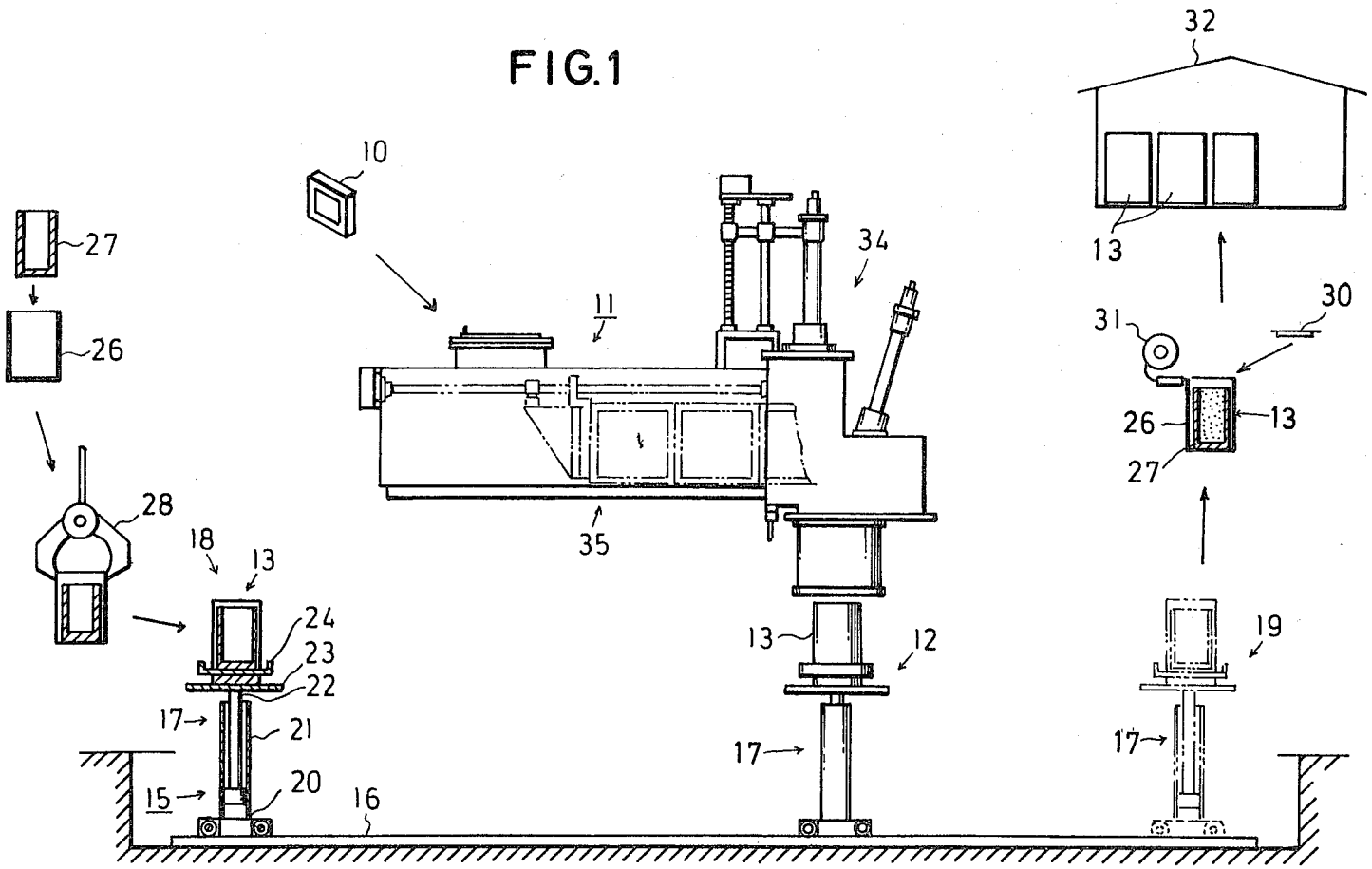
FIG. 1 illustrates the process from the preparation of a container for filling with radioactive solid wastes to the storage of the container filled with the wastes.
Figure 2:
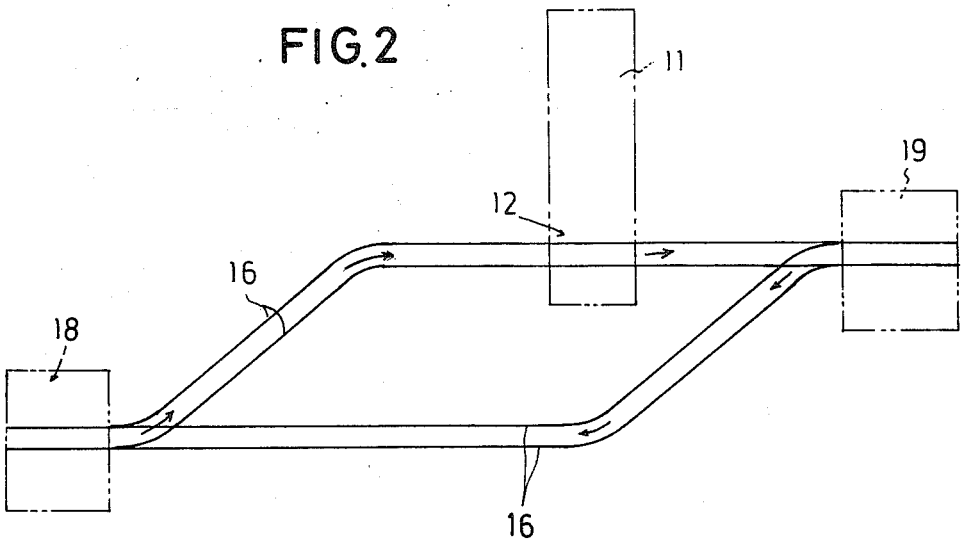
FIG. 2 is a plan view showing the travelling route of a conveying device.

Referring now to FIG. 1, reference numeral 10 designates an incombustible radioactive solid waste, and the illustrated waste is, as for one example, a filter of a construction in which filter elements are accommodated in a metal frame. It should be noted that such a radioactive waste is contaminated by radioactivity as the radioactive nuclide is adhered to the surface of the solid article, as is well-known. The waste 10 as described includes various materials such as steels, pipes, heat insulating material and so on. The waste 10 is fed into a container-filling device 11. The waste 10 fed into the container-filling device 11 is filled into a storing container 13 at a container-filling station 12 via the process, which will be latter described in detail.

The container 13 is conveyed by a conveying device 15. The conveying device 15 includes a rail 16 and a conveying body 17 travelling on the rail 16. The rail 16 is laid so as to connect a container preparing station 18, the container-filling station and a container-delivering station 19. At least two conveying bodies 17 are arranged on the rail 16, and these conveying bodies travel along the route as indicated by the arrow. it should be noted that the conveying bodies 17 may be increased in number or one conveying body will suffice as will be described later. The conveying body 17 comprises a truck 20 travelling on the rail 16, a lift device 21 disposed on the truck 20, a blocking plate 23 mounted on the upper end of a lifting rod 22 of the lift device 21, and a tray 24 mounted on the closing plate 23.

The container 13 may be of the type which can be used without modification for the purpose of storage as will be described later, that is, of the type which is adapted for use without modification for the purpose of storage in view of its construction, dimensions, cost, durability and the like. As for one example, the container used is of the construction in which a canister 26 made of metal (such as iron) is internally provided with a crucible 27 made of a refractory material (such as black lead). However, other containers of simpler construction may be also used. At a preparing station, the container 13 is placed on the tray 24 of the conveying body 17 by means of a transfer device 28 such as a crane.

At a delivering station 19, a lid 30 is put on the container 13, the lid 30 being fastened to the canister 26. This fastening can be achieved, for example, by a welding device 31. In this case, the container 13 is interiorly placed in sealed condition. The sealed container 13 is carried to a storage house 32 by a truck or other transport means for storage therein.

Next, the container-filling device 11 will be described with reference to FIGS. 3 to 7.

The container-filling device 11 includes a melting device 34 for melting the radioactive solid wastes and a feed-in device 35 for feeding the wastes into the melting device 34.

Figure 3:
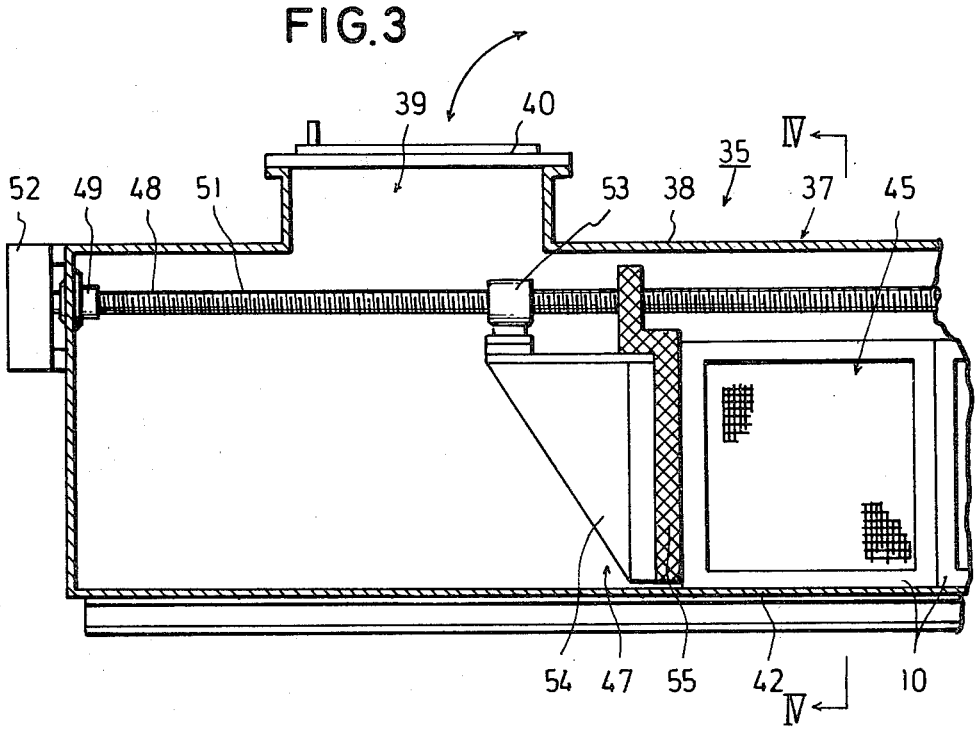
FIG. 3 is a longitudinal sectional view of the transporting device.
Figure 4:
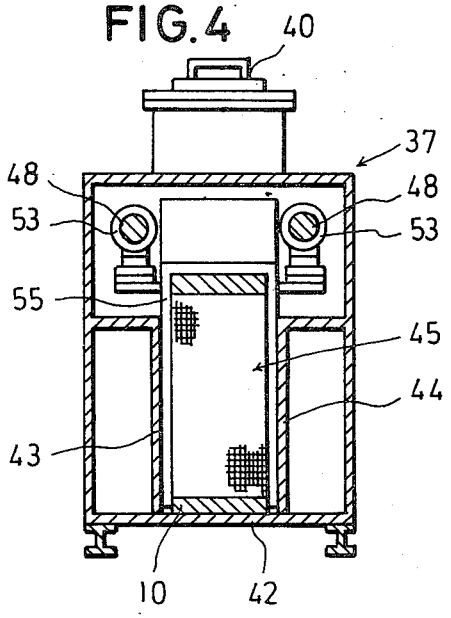
FIG. 4 is a sectional view taken on line IV—IV of FIG. 3.
Figure 5:
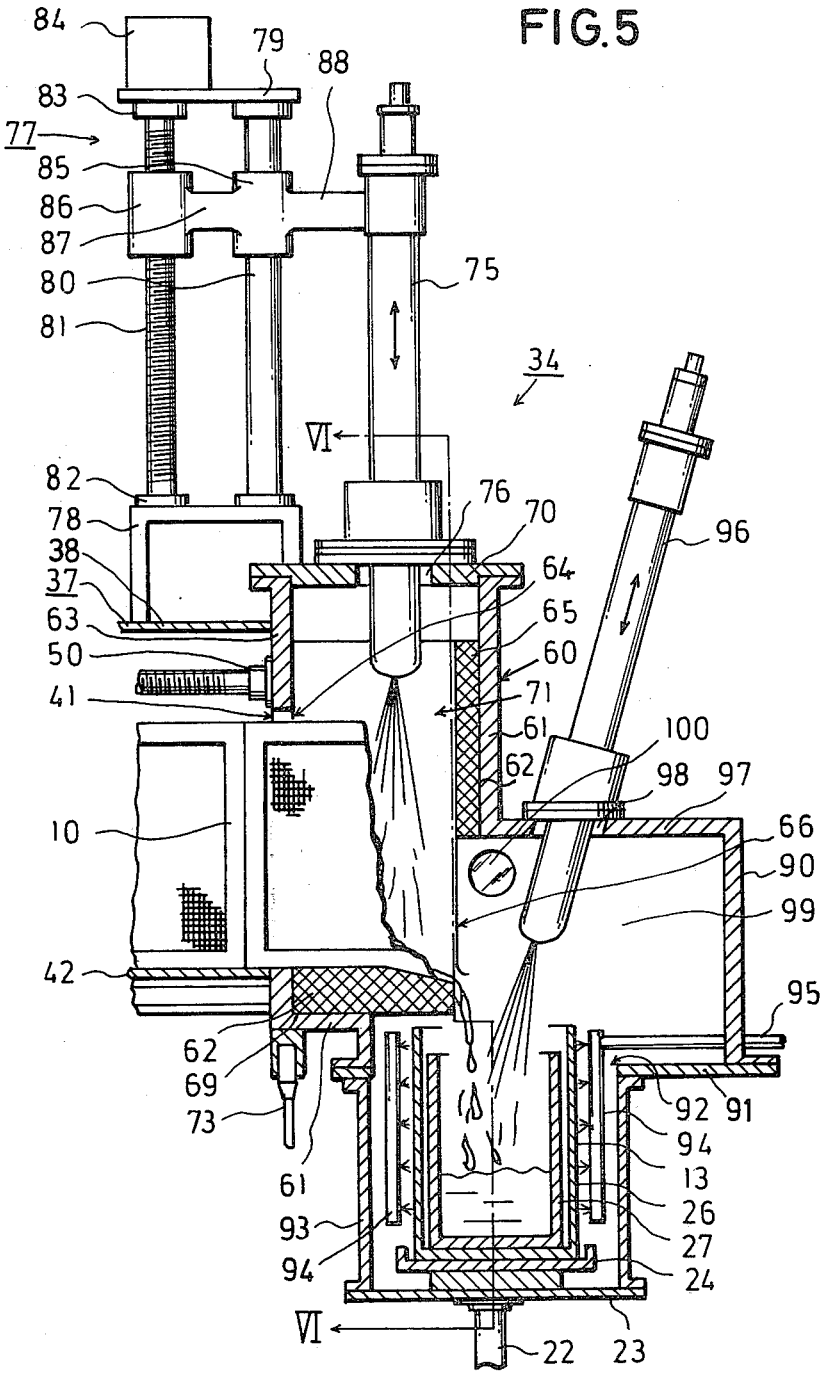
FIG. 5 is a longitudinal sectional view of a melting device.

First, as shown in FIGS. 3 and 4, the feed-in device 35 has a substantially horizontally positioned transporting frame 37. In one end of the transporting frame 37, the transporting frame 37 has a top plate 38 formed with a charge port 39 for charging the radioactive solid wastes, and a lid 40 is mounted at the charge port free to open and close. As shown in FIG. 5, the other end of the transporting frame 37 is open to form a delivery port 41 for feeding the radioactive solid wastes into the melting device 34. The transporting frame 37 further has a floor board 42 illustrated as a floor and two guide walls 43 and 44. These floor board 42 and guide walls 43 and 44 have their length from the charge port 39 to the delivery port 41, and a space surrounded by these floor board 42 and guide walls 43 and 44 forms a passage 45 through which the waste 10 is transported.

A transporting means 47 is provided on the transporting frame 37. Two feed rods 48 rotatably supported by bearings 49 and 50 are formed about the outer periphery thereof with threads 51. Both two feed rods 48 are rotated normally or reversely by means of a drive device 52. A movable body 53 is provided at its internal surface with threads in engagement with the threads 51 and is moved rightwards or leftwards as viewed in FIG. 3 by normal or reverse rotation of the feed rod 48. It will be noted that one of the aforesaid two feed rods may be formed into a mere rod-like element without having threads so as to merely function as guides. A pusher 54 connected to the movable body 53 has its front surface lined with a refractory material 55. The refractory material 55 used includes for example such as black lead. While the feed rod 48, the movable body 53 and the like have been used as a preferable means for moving the pusher 54 over the long distance, it will be noted that a long stroke fluid cylinder may be used in place of the former.

Figure 6:
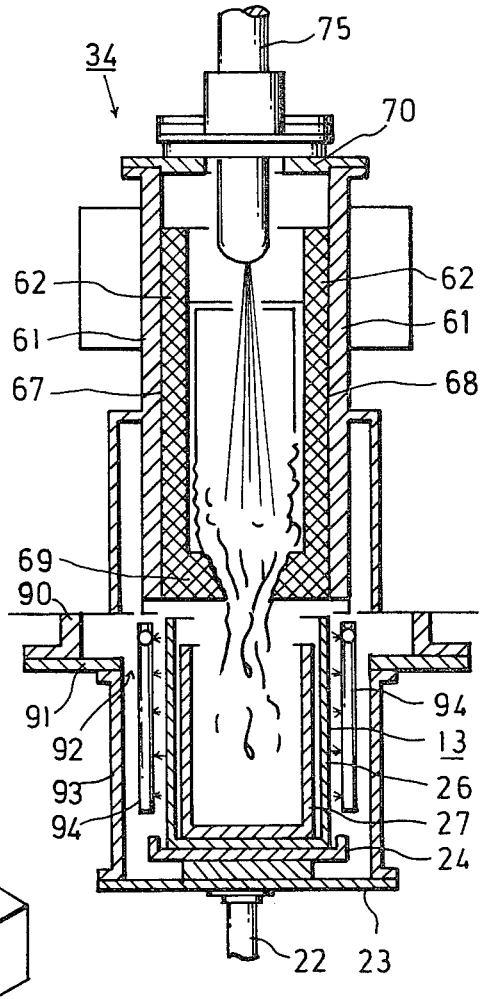
FIG. 6 is a sectional view taken on line VI—VI of FIG. 5.
Figure 7:
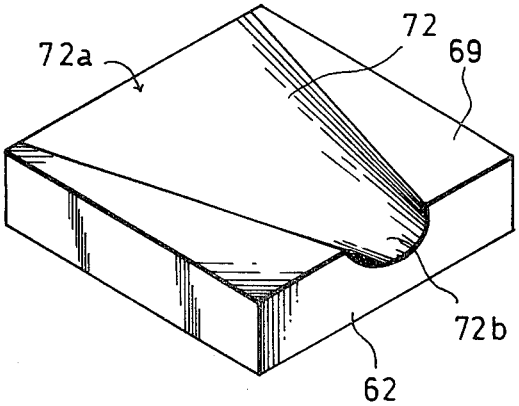
FIG. 7 is a perspective view of the bottom of a melting furnace.

The melting device 34 is principally shown in FIGS. 5 to 7. A furnace body 60 is composed of a furnace shell 61 formed from metal such as steel and having a water cooling construction and a refractory material 62 lined on the internal surfaces of the furnace shell 61. The refractory material 62 used comprises an electrically conductive black lead. The furnace body 60 further comprises a side wall 63 connected to the transporting frame 37, a side wall 65 opposed to the side wall 63, two other side walls 67, 68, a bottom wall 69 and an upper wall 70, the interior of which furnace body forms a space within which the wastes are melted. The side wall 63 and upper wall 70 are formed only by the furnace shell 61, and other side walls 65, 67, 68 and bottom wall 69 are formed by the furnace shell 61 and refractory material 62. The side wall 63 is formed with an inlet 64 in communication with the delivery port 41. The side wall 65 is formed at its lower portion with an outlet 66. The side wall 67 and side wall 68 have their respective internal surfaces which are continuous to respective internal surfaces of the guide wall 43 and guide wall 44. The bottom wall 69 has an upper surface continuous to the upper surface of the floor board 42. As shown in FIG. 7, the bottom wall 69 is formed at its upper surface with a groove 72. This groove 72 has, in a portion 72*a* close to the inlet 64, a large width extending to the side walls 67 and 68 but has little depth. Conversely, the groove has, in a portion 72*b* close to the outlet 66, a small width and a large depth. And, the groove leads to the outlet 66 smoothly without rugged portions. In the portion of the bottom wall 69, the furnace shell 61 has a terminal 73 connected to a power source device.

On the upper wall 70, there is mounted a plasma torch 75 used as a heating means in a state where it extends through a hole 76 bored in the upper wall 70. The plasma torch 75 is moved up and down by means of a lift device 77. The lift device 77 has a lower frame 78 secured to the top plate 38 of the transporting frame 37 and to the upper wall 70 of the furnace body 60. A guide post 80 is stood upright from the lower frame 78, and an upper frame 79 is mounted on the upper end of the guide post 80. A feed rod 81 rotatably supported by a pair of bearings 82 and 83 is formed about the outer periphery thereof with threads. The feed rod 81 is driven by means of a motor 84. A guide member 85 is mounted movably up and down on the guide post 80. A lifting body 86 mounted on the feed rod 81 is provided at its own internal surface with threads meshed with the threads of the feed rod 81 so that when the feed rod 81 is rotated, the lifting body moves up and down. The lifting body 86 and guide member 85 are connected by a connecting arm 87 and the guide member 85 and plasma torch 75 connected by a connecting arm 88. Accordingly, when the lifting body 86 moves up and down, the plasma torch 75 also moves up and down at the same time. Other lifting devices of suitable construction having a function similar to the device 86 may also be used.

The melting device 34 further has an encircling wall which encircles the outlet 66. The encircling wall comprises an upper encircling wall 90 designed equally to the furnace shell 61 and a lower encircling wall 91 for blocking the lower opening of the upper encircling wall 90. The lower encircling wall 91 is formed with a hole 92 of the size enough to receive the container 13 from the bottom. To the lower surface of the lower encircling wall 91 is connected an upper end of a encircling cylinder 93 so as to surround the whole circumference of the hole 92. An opening at the lower end of the encircling cylinder 93 is closed by the blocking plate 23 of the conveying body 17. The encircling cylinder 93 is interiorly provided with a cooling pipe 94. Cooling gas fed through a cooling gas(e.g.air) feed-in pipe 95 is blown from a number of nozzles disposed on the pipe 94 towards the container 13 to prevent the container 13 from being overheated. A plasma torch 96 is mounted on the upper wall 97 of the upper encircling wall 90 in a state where it extends through a hole 98. Although not shown, the plasma torch 96 can be also moved in a direction of the arrow by the lifting device similar to the aforesaid lifting device 77. A vent hole 100 disposed in the side wall 99 of the upper encircling wall 90 is placed in communication with a waste gas treating apparatus not shown. The gases blown out of the plasma torches 75 and 96 as plasma arcs and gases blown out of the cooling pipe 94 are fed to the waste gas treating apparatus through the vent hole 100.

Figure 8:
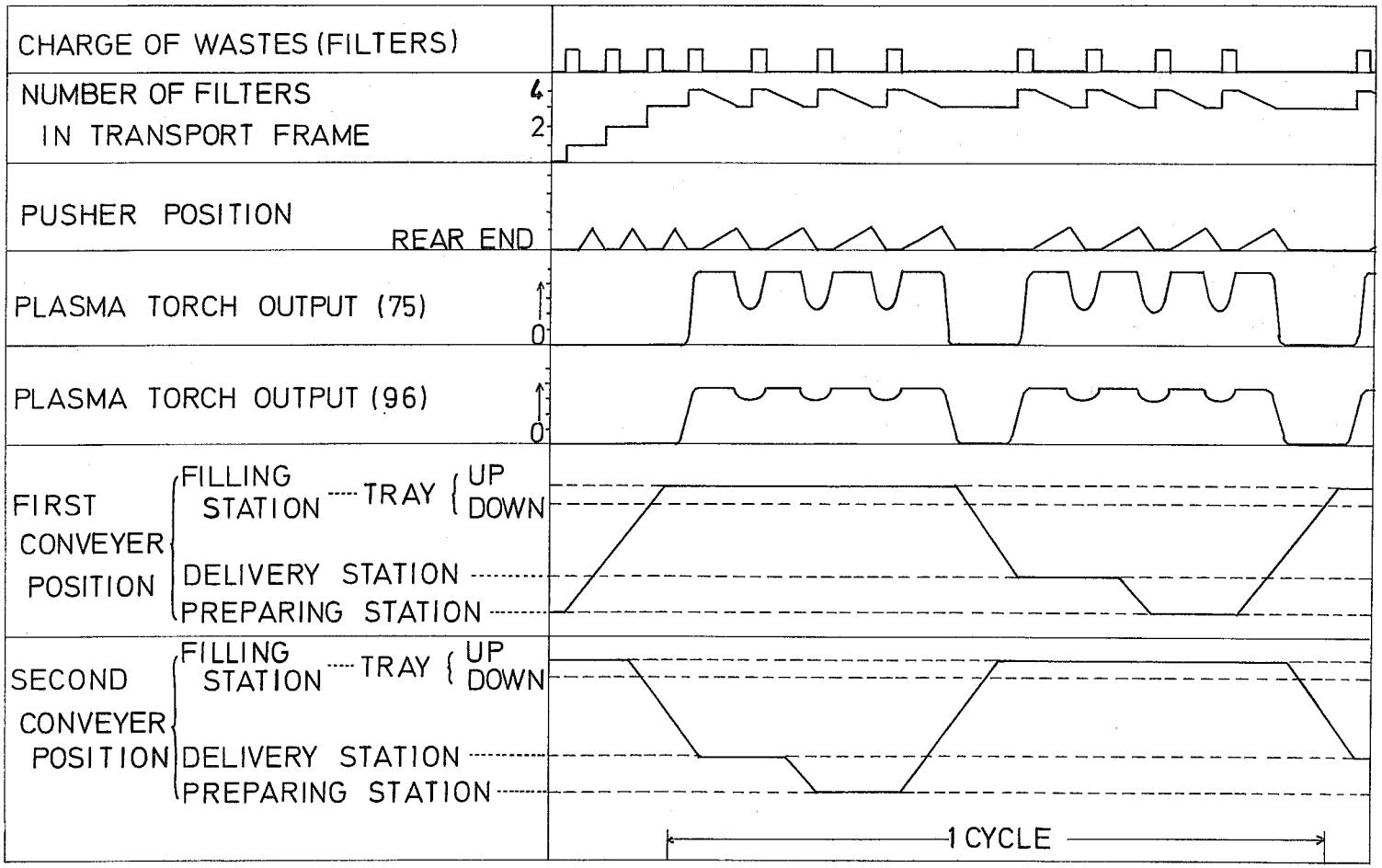
FIG. 8 is a time chart.

The operation of the above-mentioned apparatus will be described in connection with FIG. 8.

First, the waste filter 10 contaminated by radioactivity is charged into the passage 45 through the charge port 39. This charging is accomplished by the method for repeating the operation which comprises admitting a single filter 10 into the passage 45 with the pusher 54 withdrawn to the most rearward position (the left end in FIG. 3), then advancing the pusher 54 to feed the filter 10 forwardly (rightward in FIG. 3), and thereafter withdrawing again the pusher 54 to the rear end to admit a succeeding filter 10 into the passage 45. The filter has its size, for example, 610 mm×610 mm×290 mm.

Independently of the above, on the other hand, at the preparing station 18 the container 13 is placed on the tray 24 of the first conveying body 17. Then, the first conveying body 17 advances towards the container-filling station 12. At this station 12, the lifting rod 22 is moved up by actuation of the lifting device 21. Accordingly, as shown in FIGS. 5 and 6, the opening at the lower end of the encircling cylinder 93 is closed by the blocking plate 23 and the container 13 on the tray 24 is positioned under the outlet 66.

Next, the plasma torches 75 and 96 commence their operation. The plasma torch 75 used is in the form of a transfer type long flame plasma torch. In order to effect operation of the plasma torch 75, gases such as argon and nitrogen to form a plasma, cooling water and electric power are supplied in a known manner. In supply of power, the cathode of the torch 75 is connected to a negative terminal of a power supply device while the connecting terminal 73 being connected to a positive terminal of the power supply device. The voltage of the power supply used is from 600 to 1,000 V which is higher than the case where a conventional plasma torch is operated. Thus, a long plasma arc reaching the bottom wall 69 longitudinally crossing over the space where the wastes are melted is blown out of the plasma torch 75. The length of this plasma arc is for example 700 mm to 800 mm. The plasma torch 96 used is in the form of a transfer type conventional plasma torch. The plasma torch 96 is operated in a manner similar to the plasma torch 75. Power is supplied between the cathode of the torch 96 and the connecting terminal 73. The voltage used is from 80 to 200 V.

As the plasma arcs are blown out of the plasma torches 75 and 96 in a stabilized manner, advancement of the pusher 54 commences. Then, the filters 10, 10, . . . present in the passage 45 are forced forward while being guided along the guide walls 43 and 44. The foremost filter 10 is introduced into the melting space 71 through the delivery port 41 and the inlet 64. The filter 10 thus introduced into the melting space 71 is quickly melted from its front end portion by the plasma arc blown by the plasma torch 75. The thus molten melt quickly flows along the groove 72, which is inclined to be lowered towards the outlet 66, and flows down into the crucible 27 of the container 13 from the outlet 66. The melt dropped into the crucible 27 is heated by the plasma arc blown out of the plasma torch 96. With this, the melt fallen into the crucible 27 is not immediately solidified into a lump but reaches every part of the crucible 27.

After one filter 10 has been melted in a manner as described above, the outputs of the plasma torches 75 and 96 are attenuated. In this condition, the pusher 54 is withdrawn, and the succeeding waste filter 10 is introduced into the passage 45 in a manner as previously mentioned. Thereafter, the steps of operation as mentioned above are repeated so that the waste filters 10 are successively melted and the melt is forced into the crucible 27 of the container 13.

During the aforementioned operation, cooling gases are blown out of the pipe 94 towards the container 13 to prevent overheating thereof. Also, the gases blown out of the plasma torches 75 and 96 as the plasma arcs and the cooling gases are removed from the vent hole 100. Thus, the hot gases blown out of the torch 75 as the plasma arcs are prevented to flow into the passage 45 through the inlet 64. Accordingly, even if the filter elements of the filters 10 cannot resist to heat and can be readily melted, there is no fear that during the presence of the filters 10 in the passage 45, the filter elements are melted and stick to the floor board 42 so that the filters 10 become jammed.

When the melt within the crucible 27 reaches a predetermined level, the operation of the plasma torches 75 and 96 are stopped. At the same time, the pusher 54 is withdrawn in order to charge a succeeding waste filter 10 into the passage 45.

Next, the lifting rod 22 is moved down by actuation of the lifting device 21 of the first conveying body 17 to remove downwardly the container 13 from the encircling cylinder 93. Then, the first conveying body 17 is moved to the delivering station 19 to deliver the container 13. During such a process as described, the melt within the crucible 27 is solidified. The emptied first conveying body 17 is moved to the preparing station 18.

While the first conveying body 17 is travelling as described above, the second conveying body 17 with another container 13 received on the tray 24 is moved to the container filling station 12. In the manner similar to that as previously mentioned, the melt of wastes is filled into the container 13. When the melt reaches a predetermined level, the second conveying body 17 is also moved similarly to the first conveying body 17 to deliver the container 13. Thereafter the steps of the operation as described above are repeated.

While in general, the crucible 27 of the container 13 is substantially completely filled with the melt, it will be noted, for example, in the case the total weight of the container filled with the melt is desired to a predetermined level, that the melt can be sometimes filled into the crucible 27 by a few percent of the total space within the crucible 27.

In the event the filter 10 is melted by the plasma arc blown out of the plasma torch 75, the apparatus offers the following features. That is, in this apparatus, the side wall 65 is opposed to the inlet 64 and the outlet 66 is positioned under the side wall 65. Thus, even if the speed at which the filter 10 is forced forward by the pusher 54 is higher than the speed at which the filter 10 is melted by the plasma arc, the foremost end of the filter 10 abuts on the side wall 65 to impede further advancement thereof. This prevents the unmelted filter 10 from being dropped into the crucible 27 from the outlet 66.

Alternatively, the filters 10 may be intermittently melted one by one as described above, and all of the filters 10 in the passage 45 may be successively and continuously melted. In this case, the pusher 54 is continuously moved forward to the position at which the inlet 64 of the furnace body 60 is blocked, and the plasma torches 75 and 96 are continuously operated without attenuating the outputs.

It should be further noted that the above-mentioned wastes are not limited to the filters of given shape as noted above, but various large and small sizes and a great variety of shapes may also be employed. These wastes are forced forward by the pusher 54 as the latter is moved forward and are guided by the guide walls 43, 44 and floor board 42 towards the inlet 64 of the furnace body 60.

As for the heating means, oil burners or gas burners which blow flames may also be used in place of the aforesaid plasma torches 75 and 96.

In addition, where the quantity of wastes entering the passage 45 of the feed-in device 35 at a time is the quantity thereof filled into one container without overs and shorts, a single conveying body 17 can also be used. In this case, it is advisable to effect operations, one for moving the conveying body 17, during the operation of introducing the wastes into the passage 45, to deliver the container 13 filled with the wastes, and the other for positioning the emptied container 13 within the encircling cylinder 93 also during the operation of introducing the wastes into the passage 45.

Figure 9:
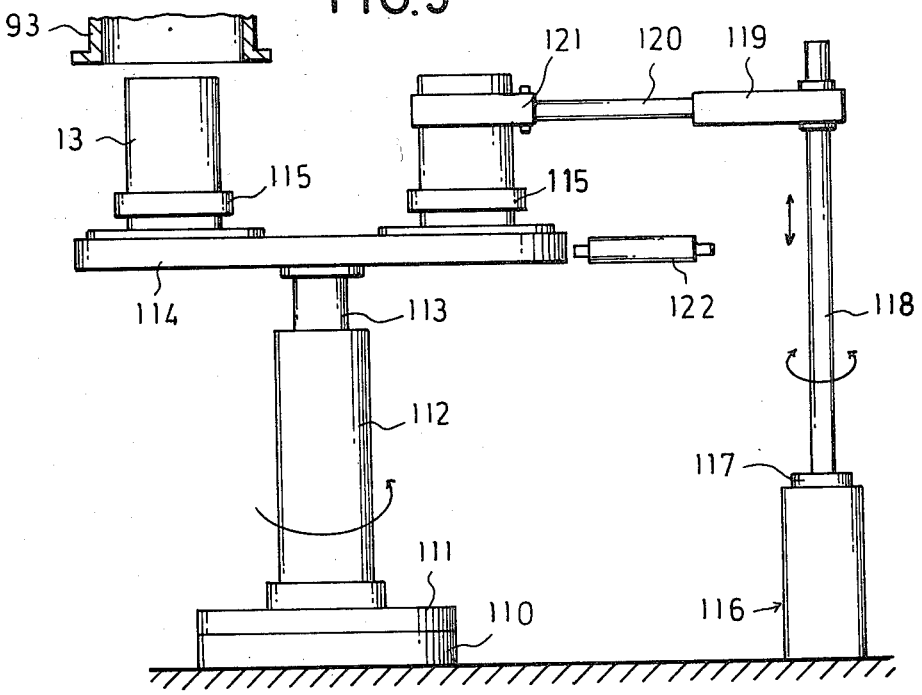
FIG. 9 is a front view showing a different mode of embodiment of the transporting means.
Figure 10:
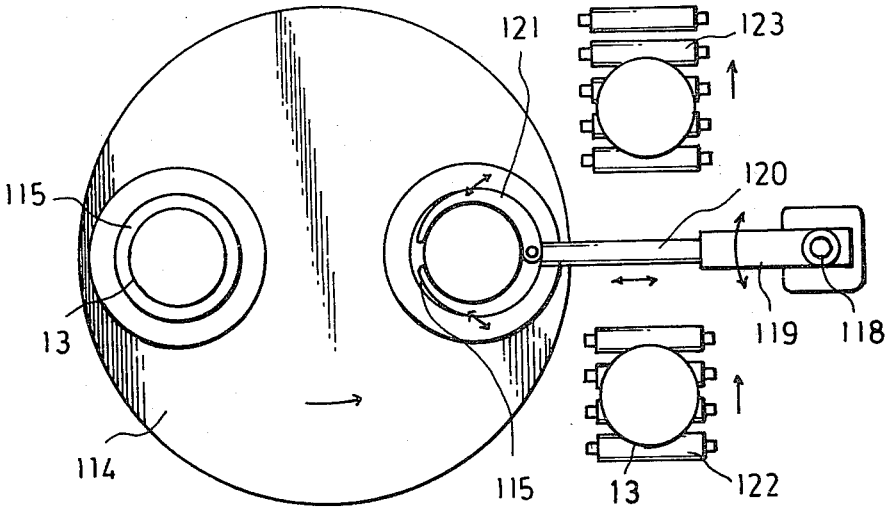
FIG. 10 is a plan view of the device shown in FIG. 9.

Another embodiment of the conveying means is shown in FIGS. 9 and 10.

A rotary device 110 has a rotary portion 111 on which a lifting device 112 is mounted. The lifting device 112 causes upward and downward movements of a lifting rod 113. A table 114 mounted on the upper end of the lifting rod 113 is provided with two trays 115. Another rotary device 116 has a rotary portion 117 on which a strut 118 is mounted. A lifting body 119 is mounted on the strut 118 movably up and down to move an arm 120 provided with a gripper 121 at the foremost end thereof into and withdrawal.

This apparatus is operated as follows:

In FIG. 9, a lefthand container 13 is empty while a righthand container 13 is filled with wastes.

The gripper 121 grips the container 13 filled with wastes to transfer the container 13 onto a conveying conveyer 123. Successively, the gripper 121 grips the empty container 13 fed by a preparing conveyer 122 to transfer said container 13 onto an emptied tray 115 and then moves away from the upper position of the table 114. Next, the table 114 moves up, the container 13 is positioned within the encircling cylinder 93 and the lower opening of the encircling cylinder 93 is blocked by the table 114. In this condition, the melt is filled into the container 13 as previously mentioned. When the melt within the container 13 reaches a predetermined level, the table 114 moves down and the table 114 is rotated by 180° in a direction of the arrow by means of the rotary device. Such a cycle of operation is repeatedly accomplished.

Figure 11:
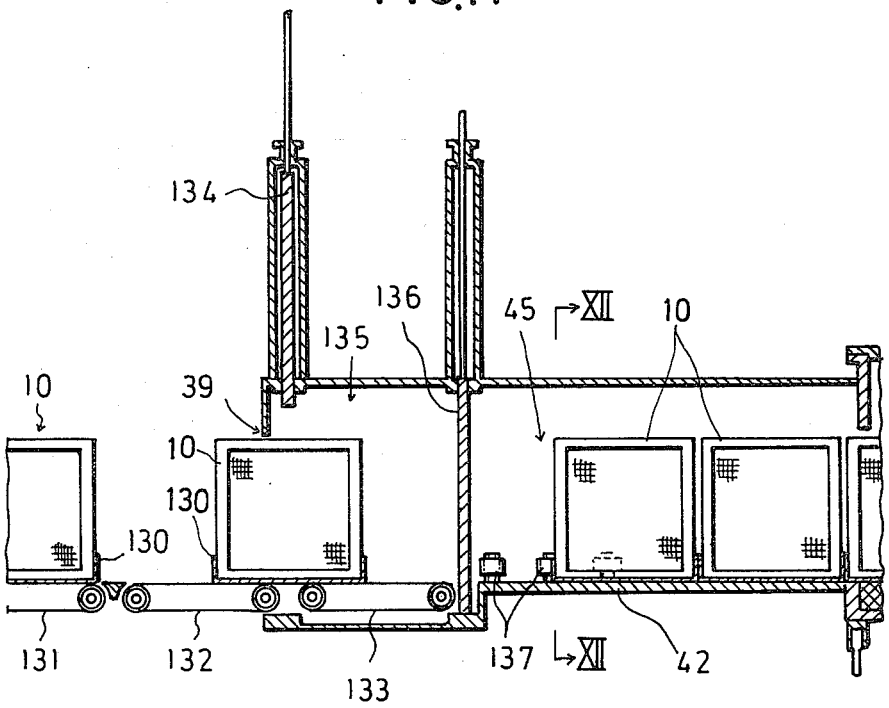
FIG. 11 is a longitudinal sectional view showing another embodiment of the transporting means.
Figure 12:
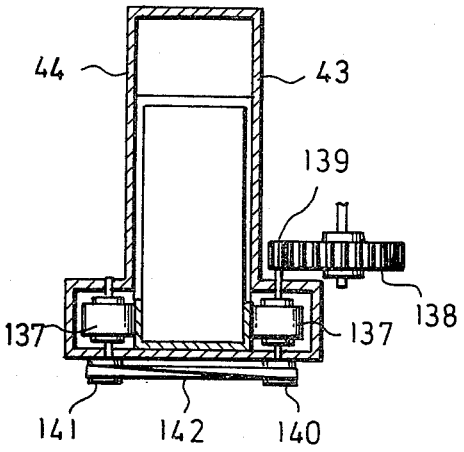
FIG. 12 is a sectional view taken on line XII—XII of FIG. 11.

Next, another embodiment of the transferring means is shown in FIGS. 11 and 12.

The waste 10 being fed by a belt conveyer 131 while being placed on a tray 130 is transferred to a belt conveyer 132. When a door 134 disposed on the charge port 39 is raised by a raising mechanism not shown, the belt conveyers 132 and 133 are operated to feed the filter 10 into a chamber 135. When the filter 10 has entered the chamber 135, the belt conveyer 133 stops to close the door 134.

Next, a door 136 is raised by a raising mechanism not shown, and the belt conveyer 133 is operated to feed the filter 10 onto the floor board 42. Three pairs of drive rollers 137 arranged on both sides of the passage 45 are driven by a motor not shown through gears 138, 139, pulleys 140, 141 and belt 142. The filter 10 delivered on the floor board 42 by the conveyer 133 is forced forward while being held by these three pairs of drive rollers 137. The thus forced forward filter 10 is introduced into the furnace body 60 together with the tray 130 and melted in a manner similar to that as previously mentioned.

If the waste is in the form of a large fixed box-shaped filter, the aforementioned tray 130 need not be used. However, if the wastes are in the form of small pieces, the tray 130 is preferably used as an auxiliary means. That is, if these wastes are placed on the tray 130, it is possible to prevent small or fine pieces of wastes from being dropped into clearances formed between the belt conveyers 131, 132 and 133 and between the belt conveyer 133 and floor board 42.

In the illustrated embodiment, the belt of the belt conveyer 133 and the floor board 42 form a floor termed in the present invention.

It is also possible to use roller conveyers in place of the above-mentioned belt conveyers. Where the roller conveyers are used, a number of rollers form a floor termed in the present invention. Further, where the tray on which fine wastes are placed is used as an auxiliary means, the tray serves as a part of the floor.

It should be noted that in this embodiment, elements equal in function to those shown in FIGS. 3 to 5 bear similar reference numerals to those used previously to omit the duplicate explanation.

Figure 13:
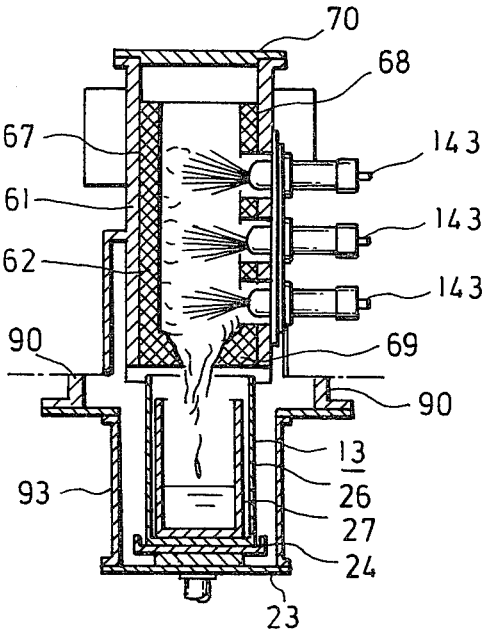
FIG. 13 is a sectional view in which another embodiment of the melting device is cut at the position similar to that of FIG. 6.

FIG. 13 illustrates a further embodiment showing how to use plasma torches in the melting device. In this embodiment, three ordinary plasma torches 143 are mounted on the side wall 68, in place of the aforementioned long frame plasma torch 75. A supply of gases, cooling water and electric power to these plasma torches 143 is achieved similarly to the case of the plasma torch 96 as described above. it is advisable to determine the number of plasma torches 143 used in such a manner that the plasma arcs blown out of the torches may cover almost entire region of the melting space 71.

As many apparently widely different embodiments of this invention may be made without departing from the spirit and scope thereof, it is to be understood that the invention is not limited to the specific embodiments thereof except as defined in the appended claims.

What is claimed is:

1. An apparatus for filling a container with radioactive solid wastes, said apparatus comprising:

(i) a transfer frame having a charge port at one end and a delivery port at the other end and interiorly having a floor extending from the charge port to the delivery port so that radioactive solid wastes introduced through the charge port and placed on the floor may be laterally moved in substantially horizontal direction on the floor towards the delivery port;

(ii) a transfer means arranged within said transfer frame so that the radioactive wastes introduced through said charge port and placed on said floor may be laterally moved on the floor towards said delivery port;

(iii) a hollow furnace body interiorly having a bottom wall on which the wastes are placed and a space for melting the radioactive solid wastes while being fed in substantially horizontal direction, said space being above the bottom wall and being of great height relative to its width in the direction of substantially horizontal feed of the wastes, said furnace body having first and second side walls which are respectively provided with an inlet for introducing the radioactive solid wastes and an outlet for discharging a melt of said wastes, said second wall being opposite to the discharge port for preventing further advance of the wastes in the feed direction thereby to prevent wastes from moving through the heating space in unmelted condition, said inlet formed in the first side wall being in communication with the delivery port of the transfer frame, said bottom wall including a groove the base of which is inclined downwardly in the direction of feed of the wastes, said outlet being below the lower end of said groove;

(iv) a heating means comprising at least one plasma torch attached to said furnace body to direct heating gases used to melt the radioactive wastes into said space; and (v) a tray, to receive a container placed thereon, disposed at a position under the outlet formed in the second side wall of said furnace body;

said transfer frame having two guide walls which extend upright from said floor and are opposed to each other so as to bound between them a space above said floor into which the solid wastes are introduced, said two guide walls extending from the charge port to the delivery port;

whereby the radioactive wastes placed on the floor are guided along said guide walls into the melting space within said furnace body, the wastes being melted by the heating gases in the melting space within the furnace body, and the resultant melt being poured through said outlet into an open-topped container placed on said tray.

2. The apparatus as defined in claim 1 wherein said apparatus further comprises two conveying bodies, said tray being disposed on each of said two conveying bodies, said conveying bodies being both moved successively to a station for receiving an empty container on the tray, a station under said outlet, and a station for delivering a container filled with wastes and placed on the tray.

3. The apparatus as defined in claim 1 wherein said apparatus comprises a hollow encircling wall disposed on the external surface of said furnace body to encircle said outlet, said encircling wall including a space disposed therein and having dimensions sufficient to receive said container, a vent hole formed in a part thereof to discharge inside gases, and an opening of dimensions sufficient to permit said container to be inserted therethrough, said opening being positioned under said outlet; said apparatus further comprising a blocking plate capable of blocking said opening of said encircling wall from the underside thereof, said blocking plate having a lifting device attached thereto capable of moving said blocking plate up and down and urging said blocking plate upwardly against said opening; said tray being provided on the upper surface of said blocking plate.

4. The apparatus as defined in claim 3 wherein said transfer means comprises a pusher which is movable in a direction from the charge port to the delivery port and in a direction opposite thereto within the space surrounded by said floor and said guide walls; said heating means mounted on said furnace body comprises a long flame plasma torch disposed on the upper wall of the furnace body and oriented towards the space interiorly of the furnace body; the lower edge of the inlet formed in said furnace body is positioned higher than the lower edge of the outlet formed in the furnace body, and the bottom wall of the furnace body is inclined obliquely downwardly from the lower edge of the inlet towards the lower edge of the outlet; said encircling wall being provided with a plasma torch on the upper wall thereof, said plasma torch being oriented towards the space for receiving therein said container; and said apparatus further comprising two conveying bodies, said blocking plate, tray and lifting device being disposed on each of said two conveying bodies, both said conveying bodies being travelled round a station for receiving an empty container on the tray, a station under said outlet, and a station for delivering a container filled with wastes and placed on the tray.

* * * * *